US008795515B2

(12) United States Patent
Zhan et al.

(10) Patent No.: US 8,795,515 B2
(45) Date of Patent: Aug. 5, 2014

(54) CATALYTIC DECHLORINATION PROCESSES TO UPGRADE FEEDSTOCK CONTAINING CHLORIDE AS FUELS

(75) Inventors: Bi-Zeng Zhan, Albany, CA (US); Michael Driver, San Francisco, CA (US); Hye-Kyung Timken, Albany, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 427 days.

(21) Appl. No.: 13/170,948

(22) Filed: Jun. 28, 2011

(65) Prior Publication Data

US 2013/0001133 A1 Jan. 3, 2013

(51) Int. Cl.

| | |
|---|---|
| ***C01G 17/00*** | (2006.01) |
| ***C10G 29/00*** | (2006.01) |
| ***C10G 29/02*** | (2006.01) |
| ***C10G 67/02*** | (2006.01) |
| ***C10G 29/16*** | (2006.01) |

(52) U.S. Cl.

CPC ..... *C10G 29/00* (2013.01); *C10G 29/02* (2013.01); *C10G 67/02* (2013.01); *C10G 29/16* (2013.01)

USPC ..... 208/262.1; 208/97

(58) Field of Classification Search

CPC ..... C10G 25/00

USPC ..... 208/133–134, 262.1, 62, 66, 95, 97

See application file for complete search history.

(56) References Cited

U.S. PATENT DOCUMENTS

| | | | | |
|---|---|---|---|---|
| 4,232,177 | A | 11/1980 | Smith, Jr. | |
| 4,307,254 | A * | 12/1981 | Smith, Jr. | 568/697 |
| 4,336,407 | A | 6/1982 | Smith, Jr. | |
| 5,107,061 | A | 4/1992 | Ou et al. | |
| 7,432,408 | B2 | 10/2008 | Timken et al. | |
| 7,495,144 | B2 | 2/2009 | Elomari et al. | |
| 7,531,707 | B2 | 5/2009 | Harris et al. | |
| 7,538,256 | B2 * | 5/2009 | Driver et al. | 585/712 |
| 7,569,740 | B2 | 8/2009 | Elomari | |
| 7,572,943 | B2 | 8/2009 | Elomari et al. | |
| 7,576,252 | B2 | 8/2009 | Elomari et al. | |
| 7,674,739 | B2 | 3/2010 | Elomari et al. | |
| 7,691,771 | B2 | 4/2010 | Harris et al. | |
| 7,732,654 | B2 | 6/2010 | Elomari | |
| 2009/0163750 | A1 * | 6/2009 | Timken et al. | 585/312 |
| 2010/0130800 | A1 | 5/2010 | Luo et al. | |

* cited by examiner

*Primary Examiner* — Prem C Singh
*Assistant Examiner* — Juan Valencia
(74) *Attorney, Agent, or Firm* — Steven H. Roth

(57) ABSTRACT

Processes for the catalytic dechlorination of one or more hydrocarbon products involve contacting a mixture comprising the hydrocarbon product(s) and a carrier gas with a dechlorination catalyst under catalytic dechlorination conditions to provide a dechlorinated hydrocarbon product, HCl, and the carrier gas. The dechlorinated hydrocarbon product may be separated from the HCl and the carrier gas to provide liquid fuel or lubricating base oil.

18 Claims, 1 Drawing Sheet

CATALYTIC DECHLORINATION PROCESSES TO UPGRADE FEEDSTOCK CONTAINING CHLORIDE AS FUELS

TECHNICAL FIELD

The present invention relates to catalytic dechlorination processes to upgrade chloride containing feedstocks.

BACKGROUND

The conversion by refining industries of light paraffins and light olefins to more valuable cuts has been accomplished by the alkylation of paraffins with olefins and by the polymerization of olefins. Such processes, which have been used since the 1940's, continue to be driven by the increasing demand for high quality and dean burning high-octane gasoline, distillate, and lubricating base oil.

Conventional alkylation processes use vast quantities of $H_2SO_4$ or HF as catalyst. The quest for an alternative catalytic system to replace the conventional catalysts has been researched by various groups in both academic and industrial institutions. Thus far, no viable replacement to the conventional processes has been commercialized.

Recently there has been considerable interest in metal halide ionic liquid catalysts as alternatives to conventional catalysts. As an example, the ionic liquid catalyzed alkylation of isoparaffins with olefins is disclosed in U.S. Pat. No. 7,432,408 to Timken, et al. Further, U.S. Pat. No. 7,572,943 to Elomari, et al. discloses the ionic liquid catalyzed oligomerization of olefins and the alkylation of the resulting oligomers (s) with isoparaffins to produce alkylated olefin oligomers.

The presence of HCl as a co-catalyst with an ionic liquid provides an increased level of catalytic activity, for example, as disclosed by the U.S. Pat. No. 7,432,408 patent. Typically, anhydrous HCl or an organic chloride co-catalyst may be combined with the ionic liquid catalyst to attain the desired level of catalytic activity and selectivity (see, e.g., U.S. Pat. No. 7,495,144 to Elomari and U.S. Pat. No. 7,531,707 to Harris, at al.). When organic chloride is used as co-catalyst with the ionic liquid, HCl may be formed in situ in the reactor during the hydrocarbon conversion process.

Hydrocarbon product(s) of ionic liquid catalyzed hydrocarbon conversions, such as alkylate or distillate or base oil, typically contain substantial amounts of is organic chloride components that are produced during the reaction. In addition, organic chloride co-catalyst may also be carried over into such hydrocarbon products. The removal of organic chloride components from the hydrocarbon products may be desirable, e.g., to prevent the formation of unwanted byproducts during combustion of liquid fuels (see, for example, U.S. Pat. No. 7,538,256 to Driver, et al., and U.S. Patent Application No. 2009/0163750 A1 (Timken, et al.)).

U.S. Pat. No. 5,107,061 to Ou, et al, discloses the removal of organochlorines from hydrocarbon streams containing olefinic compounds using an adsorbent comprising a molecular sieve in combination with alumina to form an unsaturated hydrocarbon molecule and a molecule of hydrogen chloride, wherein the hydrogen chloride is adsorbed by the adsorbent.

There is a need for processes for the efficient dechlorination of hydrocarbon products derived from ionic liquid catalyzed hydrocarbon conversion reactions.

SUMMARY

Figure 1A:
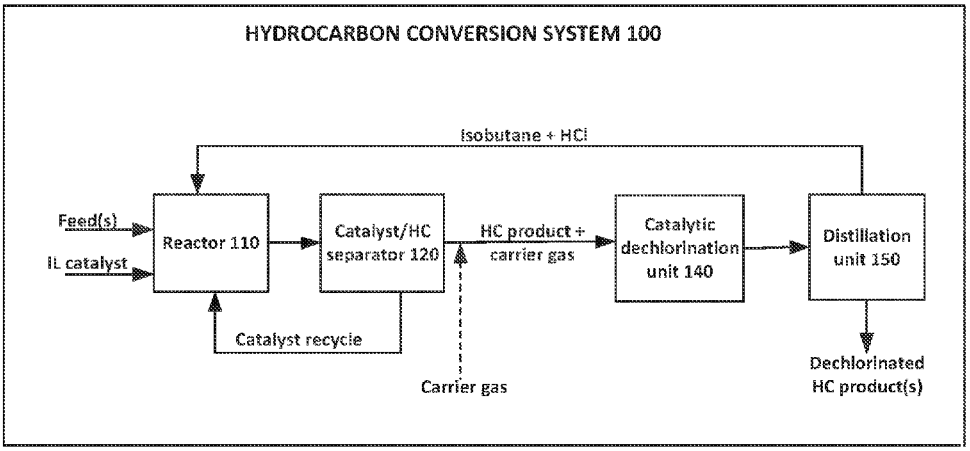
FIG. 1A represents a scheme for a hydrocarbon conversion and hydrocarbon product dechlorination process, according to an embodiment of the present invention.

The present invention provides processes for the catalytic dechlorination of hydrocarbon products derived from ionic liquid catalyzed hydrocarbon conversion reactions in a hydrocarbon conversion zone, wherein the hydrocarbon products are contacted with a dechlorination catalyst in a dechlorination zone to provide dechlorinated hydrocarbon products and HCl. The catalytic dechlorination may be performed in the presence of a carrier gas. The present invention also provides for the separation of the carrier gas and HCl from the dechlorinated hydrocarbon products, as well as recycling of the carrier gas and/or HCl to the hydrocarbon conversion zone. In an embodiment, the carrier gas and HCl may comprise a reactant and a catalyst promoter, respectively, for the hydrocarbon conversion reactions.

According to one aspect of the present invention there is provided a dechlorination process comprising feeding a mixture comprising a hydrocarbon product and a carrier gas to a catalytic dechlorination zone, wherein the hydrocarbon product comprises at least one organochloride contaminant; contacting the mixture with a dechlorination catalyst within the catalytic dechlorination zone under catalytic dechlorination conditions to provide an effluent comprising: i) the carrier gas, ii) HCl, and iii) a dechlorinated hydrocarbon product; and, via a distillation unit, separating the dechlorinated hydrocarbon product from the carrier gas and the HCl.

In an embodiment, the present invention also provides a dechlorination process comprising feeding a mixture from an ionic liquid catalyzed hydrocarbon conversion reaction in a hydrocarbon conversion zone to a catalytic dechlorination zone, wherein the mixture comprises a hydrocarbon product and a carrier gas, and the hydrocarbon product comprises at least one organochloride contaminant; contacting the organochloride contaminant with a dechlorination catalyst within the catalytic dechlorination zone under catalytic dechlorination conditions to provide: i) the carrier gas, ii) HCl, and iii) a dechlorinated hydrocarbon product; and separating the dechlorinated hydrocarbon product from the carrier gas and the HCl.

In another embodiment, the present invention further provides an integrated hydrocarbon conversion and hydrocarbon product dechlorination process, comprising contacting a first reactant comprising a $C_4$-$C_{10}$ isoparaffin and a second reactant comprising a $C_2$-$C_{10}$ olefin with an ionic liquid catalyst in a hydrocarbon conversion zone under hydrocarbon conversion conditions to provide a biphasic mixture; separating the biphasic mixture into an ionic liquid phase and a hydrocarbon phase, wherein the hydrocarbon phase comprises a hydrocarbon product and the first reactant, and the hydrocarbon product includes at least one organochloride contaminant; contacting the hydrocarbon phase with a dechlorination catalyst within a catalytic dechlorination zone under catalytic dechlorination conditions to provide: i) the first reactant, ii) HCl, and iii) a dechlorinated hydrocarbon product; and separating the dechlorinated hydrocarbon product from the first reactant and the HCl.

As used herein, the terms "comprising" and "comprises" mean the inclusion of named elements or steps that are identified following those terms, but not necessarily excluding other unnamed elements or steps.

DETAILED DESCRIPTION

Ionic liquid catalysts may be useful for a range of hydrocarbon conversion reactions, including paraffin alkylation, paraffin isomerization, olefin isomerization, olefin dimerization, olefin oligomerization, olefin polymerization and aromatic alkylation. However, hydrocarbon products from ionic liquid catalyzed hydrocarbon conversion processes may contain undesirably high levels of organic halides, e.g., various alkyl chlorides.

Applicants have now discovered that hydrocarbon products from ionic liquid catalyzed hydrocarbon conversion processes may be efficiently dechlorinated catalytically by contacting the hydrocarbon product with a dechlorination catalyst in a catalytic dechlorination zone under catalytic dechlorination conditions to provide a dechlorinated product, wherein the chloride content of the dechlorinated product is low enough to allow blending into refinery products.

Ionic Liquid Catalysts

Ionic liquids are generally organic salts with melting points below 100° C. and often below room temperature. They may find applications in various chemical reactions, solvent processes, and electrochemistry. The use of chloroaluminate ionic liquids as alkylation catalysts in petroleum refining has been described, for example, in commonly assigned U.S. Pat. Nos. 7,531,707, 7,569,740, and 7,732,654, the disclosure of each of which is incorporated by reference herein in its entirety.

Most ionic liquids are prepared from organic cations and inorganic or organic anions. Cations include, but are not limited to, ammonium, phosphonium and sulphonium. Anions include, but are not limited to, $BF_4^-$, $PF_6^-$, haloaluminates such as $Al_2Cl_{7-}$ and $Al_2Br_7^-$, $[(CF_3SO_2)_2N]^-$, alkyl sulfates ($RSO_3^-$), and carboxylates ($RCO_2^-$). Ionic liquids for acid catalysis may include those derived from ammonium halides and Lewis acids, such as $AlCl_3$, $TiCl_4$, $SnCl_4$, and $FeCl_3$. Chloroaluminate ionic liquids are perhaps the most commonly used ionic liquid catalyst systems for acid catalyzed reactions.

Exemplary ionic liquids that may be used in practicing the instant invention may comprise at least one compound of the general formulas A and B:

A

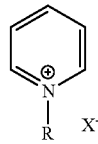

B

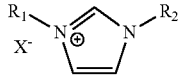

wherein R is selected from the group consisting of H, methyl, ethyl, propyl, butyl, pentyl or hexyl, each of $R_1$ and $R_2$ is selected from the group consisting of H, methyl, ethyl, propyl, butyl, pentyl or hexyl, wherein $R_1$ and $R_2$ may or may not be the same, and X is a chloroaluminate.

Examples of chloroaluminate ionic liquid catalysts that may be used in practicing the instant invention include those comprising 1-butyl-4-methyl-pyridinium chloroaluminate, 1-butyl-3-methyl-imidazolium chloroaluminate, 1-H-pyridinium chloroaluminate, N-butylpyridinium chloroaluminate, and mixtures thereof.

Feedstocks for Ionic Liquid Catalyzed Processes

In an embodiment, feeds for the present invention may comprise various streams in a petroleum refinery, a gas-to-liquid conversion plant, a coal-to-liquid conversion plant, or in naphtha crackers, middle distillate crackers, or wax crackers, including FCC off-gas, FCC light naphtha, coker off-gas, coker naphtha, hydrocracker naphtha, and the like. In an embodiment, such streams may contain isoparaffin(s) and/or olefin(s).

Examples of olefin containing streams include FCC off-gas, coker gas, olefin metathesis unit off-gas, polyolefin gasoline unit off-gas, methanol to olefin unit off-gas, FCC light naphtha, coker light naphtha, Fischer-Tropsch unit condensate, and cracked naphtha. Some olefin containing streams may contain two or more olefins selected from ethylene, propylene, butylenes, pentenes, and up to $C_{10}$ olefins. Such olefin containing streams are further described, for example, in U.S. Pat. No. 7,572,943, the disclosure of which is incorporated by reference herein in its entirety.

Examples of isoparaffin containing streams include, but are not limited to, FCC naphtha, hydrocracker naphtha, coker naphtha, Fisher-Tropsch unit condensate, and cracked naphtha. Such streams may comprise a mixture of two or more isoparaffins. In a sub-embodiment, a feed for an ionic liquid catalyzed process of the invention may comprise isobutane, which may be obtained, for example, from a hydrocracking unit or may be purchased.

In an embodiment, olefins and isoparaffins in the feed(s) may participate in ionic liquid catalyzed isoparaffin-olefin alkylation reactions. In another embodiment, olefins in the feed(s) may undergo oligomerization when contacted with an ionic liquid catalyst in a hydrocarbon conversion reactor. Ionic liquid catalyzed olefin oligomerization may take place under the same or similar conditions as ionic liquid catalyzed olefin-isoparaffin alkylation. Ionic liquid catalyzed olefin oligomerization and olefin-isoparaffin alkylation are disclosed, for example, in commonly assigned U.S. Pat. Nos. 7,572,943 and 7,576,252, both to Elomari, et al., the disclosures of which are incorporated by reference herein in their entirety.

Reaction Conditions for Ionic Liquid Catalyzed Hydrocarbon Conversions

Due to the low solubility of hydrocarbons in ionic liquids, hydrocarbon conversion reactions in ionic liquids (including isoparaffin-olefin alkylation reactions) are generally biphasic and occur at the interface in the liquid state. The volume of ionic liquid catalyst in the reactor may be generally in the range from about 1 to 70 vol %, and usually from about 4 to 50 vol %. Generally, vigorous mixing is used (e.g., by stirring, an in-line mixer, or Venturi nozzle dispensing) to ensure good contact between the reactants and the ionic liquid catalyst.

The reaction temperature may be generally in the range from about −40° F. to +480° F., typically from about −4° F. to +210° F., and often from about +40° F. to +140° F. The reactor pressure may be in the range from atmospheric pressure to about 8000 kPa. Typically, the reactor pressure is sufficient to keep the reactants in the liquid phase.

Residence time of reactants in the reactor may generally be in the range from a few seconds to hours, and usually from about 0.5 min to 60 min. In the case of ionic liquid catalyzed isoparaffin-olefin alkylation, the reactants may be introduced in an isoparaffin:olefin molar ratio generally in the range from about 1-100, more typically from about 2-50, and often from about 2-20. Heat generated by the reaction may be dissipated using various means well known to the skilled artisan.

Ionic Liquid Catalyzed Hydrocarbon Conversion Processes and System

With reference to FIG. 1A, a hydrocarbon conversion and dechlorination system 100 according to an embodiment of the present invention may include a hydrocarbon conversion reactor 110, a catalyst/hydrocarbon separator 120, a catalytic dechlorination unit 140, and a distillation unit 150.

During an ionic liquid catalyzed hydrocarbon conversion process of the instant invention, dry feeds may be introduced into reactor 110. Reactor 110 may also be referred to herein as a hydrocarbon conversion zone. The dry feeds may include at least one hydrocarbon reactant, which may be introduced into reactor 110 via one or more reactor inlet ports (not shown). In an embodiment, the at least one hydrocarbon reactant may comprise a first reactant comprising a $C_4$-$C_{10}$ isoparaffin and a second reactant comprising a $C_2$-$C_{10}$ olefin.

Ionic liquid catalyst may be introduced into reactor 110 via a separate inlet port (not shown). In an embodiment, the ionic liquid catalyst may comprise a chloroaluminate ionic liquid. The feeds to reactor 110 may further include a co-catalyst or catalyst promoter, such as anhydrous HCl or an alkyl halide. In an embodiment, the catalyst promoter may comprise a $C_2$-$C_6$ alkyl chloride. In a sub-embodiment, the catalyst promoter may comprise n-butyl chloride or i-butyl chloride. Reactor conditions may be adjusted to optimize process performance for a particular hydrocarbon conversion process of the present invention.

During hydrocarbon conversion processes of the invention, reactor 110 may contain a biphasic mixture comprising ionic liquid catalyst and a hydrocarbon phase. The hydrocarbon phase may comprise at least one hydrocarbon product of the ionic liquid catalyzed reaction. The ionic liquid phase may be separated from the hydrocarbon phase via separator 120, wherein the hydrocarbon and ionic liquid catalyst phases may be allowed to settle under gravity, by using a coalescer, or by a combination thereof. The use of coalescers for liquid-liquid separations is described in US Publication Number 20100130800A1, the disclosure of which is incorporated by reference herein in its entirety.

In an embodiment, at least a portion of the ionic liquid phase from separator 120 may be recycled directly to reactor 110. However, with continued operation of system 100, the ionic liquid catalyst may become at least partially deactivated. In order to maintain catalytic activity of the ionic liquid, a portion of the ionic liquid phase may be fed to a regeneration unit (not shown) for regeneration of the ionic liquid catalyst. Methods for the regeneration of chloroaluminate ionic liquid catalysts are disclosed, e.g., in commonly assigned U.S. Pat. Nos. 7,674,739 and 7,691,771, the disclosure of each of which is incorporated by reference herein in its entirety.

Figure 1B:
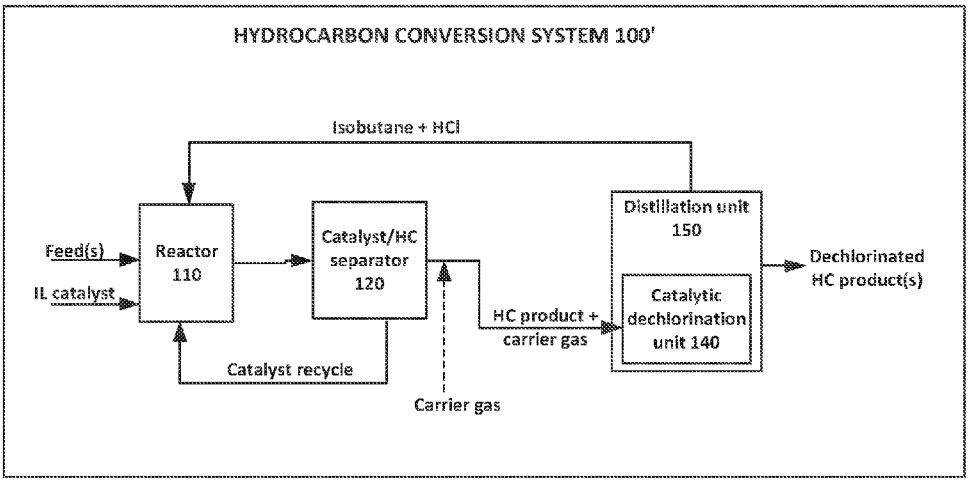
FIG. 1B represents a scheme for a hydrocarbon conversion and hydrocarbon product dechlorination process, according to another embodiment of the present invention.

With reference to FIG. 1B, an ionic liquid catalyzed hydrocarbon conversion and dechlorination system 100' according to another embodiment of the invention may include a hydrocarbon conversion reactor 110, a catalyst/hydrocarbon separator 120, a catalytic dechlorination unit 140, and a distillation unit 150.

With further reference to FIG. 1B, the hydrocarbon phase may be obtained substantially as described with reference to FIG. 1A, wherein the hydrocarbon phase comprises at least one hydrocarbon product. In the embodiment of FIG. 1B, catalytic dechlorination unit 140 may be integral with or disposed within distillation unit 150, such that the hydrocarbon product may be dechlorinated via catalytic distillation. Catalytic distillation may also be known as reactive distillation or catalytic reactive distillation (see, e.g., U.S. Pat. Nos. 4,232,177; 4,307,254; and 4,336,407, the disclosure of each of which is incorporated by reference herein for all purposes).

Dechlorination of Ionic Liquid Catalyzed Hydrocarbon Conversion Products

With further reference to FIGS. 1A and 1B, the hydrocarbon phase from separator 120 may be fed to catalytic dechlorination unit 140 for catalytic dechlorination of the hydrocarbon product. Catalytic dechlorination unit 140 may also be referred to herein as a catalytic dechlorination zone. The hydrocarbon phase fed to catalytic dechlorination unit 140 may comprise a mixture of at least one hydrocarbon product and a carrier gas. In an embodiment, the hydrocarbon product may comprise alkylate gasoline, diesel fuel, jet fuel, base oil, and the like, and combinations thereof.

The hydrocarbon product may include at least one organochloride contaminant. In an embodiment, the organochloride contaminant(s) of the hydrocarbon product may comprise one or more alkyl chlorides, e.g., a $C_2$-$C_{16}$ alkyl chloride. In an embodiment, the hydrocarbon product feed to catalytic dechlorination unit 140 may have an organic chloride content generally in the range from about 50 ppm to 5000 ppm, typically from about 100 ppm to 4000 ppm, and often from about 200 ppm to 3000 ppm.

In an embodiment, the hydrocarbon phase fed to catalytic dechlorination unit 140 may comprise a mixture of the hydrocarbon product and a reactant that was fed to reactor 110 during the ionic liquid catalyzed hydrocarbon conversion reaction, and the reactant may serve as the carrier gas for dechlorination. As a non-limiting example, a $C_4$-$C_{10}$ isoparaffin may be fed to reactor 110 together with an olefin at an isoparaffin/olefin molar ratio greater than unity. Excess isoparaffin reactant may be present in the hydrocarbon phase, and the isoparaffin may serve as the carrier gas. In a sub-embodiment, the carrier gas may comprise isobutane.

In another embodiment an extraneous carrier gas, a gas other than a reactant fed to reactor 110, may be fed to catalytic dechlorination unit 140 together with the hydrocarbon phase. As examples, the carrier gas may be selected from nitrogen, hydrogen, a $C_1$-$C_4$ hydrocarbon, and the like, and combinations thereof. In an embodiment, the carrier gas in the feed to catalytic dechlorination unit 140 may comprise a mixture of an isoparaffin reactant and an extraneous carrier gas.

In an embodiment, the mixture of hydrocarbon product and carrier gas fed to catalytic dechlorination unit 140 may have a carrier gas/hydrocarbon product molar ratio generally in the range from about 0.1-50, typically from about 0.2-20, and often from about 2-20. Catalytic dechlorination unit 140 may contain a dechlorination catalyst. The dechlorination catalyst may comprise a refractory oxide, such as silica, silica-alumina, alumina, zinc oxide, titania, zirconia, magnesium oxide, activated carbon, or a zeolite, and combinations thereof an embodiment, the dechlorination catalyst may consist essentially of alumina. In another embodiment, the dechlorination catalyst may comprise a zeolite.

HCl may be generated from organochloride contaminants of the hydrocarbon product during dechlorination by catalytic dechlorination unit 140. While not being bound by any theory, in an embodiment the carrier gas may promote catalytic dechlorination of the hydrocarbon product by flushing the HCl from catalytic dechlorination unit 140.

Within catalytic dechlorination unit 140, the hydrocarbon product/carrier gas mixture may be contacted with the dechlorination catalyst under catalytic dechlorination conditions to provide: i) the carrier gas, ii) HCl, and iii) a dechlorinated hydrocarbon product. In an embodiment, an effluent comprising the carrier gas, the HCl, and the dechlorinated hydrocarbon product may be fed from catalytic dechlorination unit 140 to distillation unit 150 for separation of the dechlorinated hydrocarbon product from the carrier gas and the HCl via distillation.

The catalytic dechlorination conditions within catalytic dechlorination unit 140 may comprise a reaction temperature generally in the range from about 40° F. to 700° F., typically from about 100° F. to 600° F., and often from about 200° F. to 500° F. The catalytic dechlorination conditions may include a reaction pressure generally in the range from about 10 to 1000 psig, and typically from about 30 to 600 psig. A liquid hourly space velocity (LHSV) feed rate to catalytic dechlorination unit 140 may be generally in the range from about 0.1 to 50 $hr^{-1}$, and typically from about 0.5 to 20 $hr^{-1}$.

In an embodiment, the catalytic dechlorination conditions within catalytic dechlorination unit 140 may include the absence of hydrogen gas. Although hydrogen gas is not required for catalytic dechlorination according to the instant invention, in an embodiment hydrogen may serve as a carrier gas.

In an embodiment, catalytic dechlorination unit 140 may be integral with distillation unit 150 (see, e.g., FIG. 1B), and the hydrocarbon product may be dechlorinated and separated from the carrier gas and HCl via catalytic distillation within distillation unit 150. In a sub-embodiment, catalytic dechlorination unit 140 may comprise a refractory oxide catalyst disposed in a lower portion of distillation unit 150 and maintained under catalytic dechlorination conditions, e.g. at a temperature in the range from about 100° F. to 600° F., and often from about 200° F. to 500° F. In an embodiment, catalytic dechlorination unit 140 may function both as a catalyst bed for catalytic dechlorination of the hydrocarbon product and as a boiler for distillation unit 150.

The hydrocarbon product, e.g., alkylate, feed to catalytic dechlorination unit 140 may typically have a much higher chloride content as compared with that of the dechlorinated product obtained from catalytic dechlorination unit 140. In an embodiment, a first chloride content of the hydrocarbon product feed to catalytic dechlorination unit 140 may be generally greater than 50 ppm, typically greater than 100 ppm, and often greater than 200 ppm.

In contrast, a second chloride content of the dechlorinated hydrocarbon product is lower than that of the hydrocarbon product feed to catalytic dechlorination unit 140. As a non-limiting example, the second chloride content of the dechlorinated hydrocarbon product may be at least 20% less, at least 60% less, or at least 90% less than the first chloride content of the hydrocarbon product feed to catalytic dechlorination unit 140.

In another embodiment, dechlorination processes of the instant invention may be combined with other dechlorination steps for further reducing the chloride content of the hydrocarbon product. As non-limiting examples, the dechlorinated products of systems 100 and 100' may comprise alkylate gasoline, jet fuel, diesel fuel, base oil, and the like.

Again with reference to FIGS. 1A and 1B, the dechlorinated product obtained from distillation unit 150 may comprise alkylate gasoline, having similar or substantially the same octane number and boiling point distribution as compared with the alkylate feed, while the chloride content is greatly decreased. Analogous results will be obtained when the present invention is practiced using catalyst systems based on halides other than chlorides.

After separation of the carrier gas and HCl from the dechlorinated product, at least one of the carrier gas and HCl may be recycled to reactor 110. Since HCl may serve as a promoter of ionic liquid catalyzed hydrocarbon conversion reactions, the required amount of fresh HCl or organic halide promoter is thereby decreased, thus providing a substantial economic benefit to the overall hydrocarbon conversion process of the invention.

In an embodiment, the carrier gas fed to catalytic dechlorination unit 140 comprises a reactant for the ionic liquid catalyzed hydrocarbon conversion reaction. In a sub-embodiment, isobutane is a reactant fed to reactor 110 in excess, e.g., at an isobutane/olefin molar ratio in the range from about 2 to 20, and the excess isobutane present in the hydrocarbon phase from separator 120 may conveniently serve as carrier gas during the catalytic dechlorination step. The isobutane reactant recovered from distillation unit 150 may be recycled to reactor 110 to afford additional substantial economic benefit to processes of the present invention.

The following examples are illustrative of the present invention, but are not intended to limit the invention in any way beyond what is contained in the claims which follow.

EXAMPLES

Example 1

Catalytic Dechlorination of Alkylate Feed in the Presence of $N_2$ Carrier Gas (Invention)

An alkylate feed from an ionic liquid catalyzed isoparaffin/olefin alkylation reaction was catalytically dechlorinated over 20 cc of an alumina extrudate catalyst in the presence of a 174 cc/min $N_2$ carrier gas in a ¾" inch diameter tube dechlorination reactor. The ratio of reactor diameter to the size of catalyst was about 10. The alkylate feed had a chloride content of 325 ppm and other characteristics as shown in Table 1. The dechlorination conditions were an LHSV of 0.5 $hr^{-1}$, a carrier gas/alkylate molar ratio of 7, a total unit pressure of 100 psig, and a catalyst bed temperature of 350° F.

TABLE 1

Characteristics of alkylate feed for catalytic dechlorination in Example 1

| | |
|---|---|
| Cl, ppm | 325 |
| API gravity | 70.4 |
| Simdist, wt % | ° F. |
| 5 | 77 |
| 50 | 204 |
| 95 | 344 |

The dechlorination step lowered the chloride content of the feed (325 ppm) to 30-40 ppm chloride content in the hydrocarbon product, showing 88-92% conversion of organic chlorides. The reduction of chloride level was maintained approximately constant for about 200 hours of operation,

Example 2

Catalytic Dechlorination of Alkylate Feed in the Presence of Isobutane Carrier Gas (Invention)

Use of isobutane carrier gas was examined using the same reactor configuration described in Example 1, except isobutane carrier gas was used instead of the $N_2$ gas. 0.83 cc/min of liquefied isobutane was pumped to the dechlorination reactor along with the alkylate feed, which corresponds to a 7:1 molar ratio of isobutane to alkylate. In our reaction conditions, the isobutane was vaporized inside the dechlorination reactor and served as a carrier-gas.

The dechlorination step lowered the chloride content of the feed (325 ppm) to 50-60 ppm chloride content in the hydrocarbon product, showing 82-85% conversion of organic chlorides. The reduction of chloride level was maintained approximately constant for about 240 hours of operation.

Example 3

Catalytic Dechlorination of Alkylate Feed in the Absence of Carrier Gas (Non-Invention)

At the end of experiments for Example 2, the carrier gas flow to the dechlorination reactor was turned off. We observed a rapid increase in the organic chloride level of the product to 250 ppm in the first 24 hours, which corresponds to 23% conversion of organic chlorides. The conversion of organic chlorides gradually further declined to less than 10% conversion as the run progressed another 24 hours on stream. This Example clearly indicates that the presence of a carrier gas is needed to maintain the dechlorination of the alkylate feed.

Based on these experiments, we concluded that a carrier gas promotes catalytic dechlorination of the hydrocarbon product containing organic chlorides. These observations suggest that the carrier gas keeps the dechlorination catalyst active by flushing HCl reaction product from the catalyst surface.

Example 4

GC Analysis of Alkylate Feed and Dechlorinated Product

An alkylate feed from an ionic liquid catalyzed isoparaffin/olefin alkylation reaction was catalytically dechlorinated over an alumina extrudate catalyst at various temperatures ranging from 350 to 500° F. in the presence of $N_2$ carrier gas under the following dechlorination conditions: 1.0 $hr^{-1}$ LHSV, a carrier gas/alkylate molar ratio of 7, and a total unit pressure of 300 psig. Analyses of the alkylate feed and of the dechlorinated product for each dechlorination temperature are shown in Table 2. The chloride content of the alkylate feed was greatly reduced by catalytic dechlorination with 60-80% conversion of organic chlorides. No substantial differences in the $C_7$-$C_9$ composition and no degradation of gasoline quality were observed after catalytic dechlorination at temperatures up to at least 500° F.

TABLE 2

$C_7$-$C_9$ analysis of alkylate product after catalytic dechlorination at 350-500° F.

| | Feed | Dechlorinated Products | | |
|---|---|---|---|---|
| C.A.T. Temp., ° F. | — | 350 | 400 | 500 |
| Main Hydrocarbon Composition | | | | |
| Total $C_8$, % | 41.1 | 42.4 | 41.6 | 41.2 |
| Total $C_7$, % | 25.3 | 24.6 | 24.4 | 25.7 |
| Total $C_9$, % | 9.0 | 9.7 | 9.4 | 9.0 |
| Trimethylpentane (TMP) in total $C_8$ | 80.2% | 80.0% | 80.1% | 80.3% |

There are numerous variations on the present invention which are possible in light of the teachings and supporting examples described herein. It is therefore understood that within the scope of the following claims, the invention may be practiced otherwise than as specifically described or exemplified herein.

What is claimed is:

1. A dechlorination process, comprising:

a) feeding a mixture comprising a hydrocarbon product and a carrier gas to a catalytic dechlorination zone, wherein the hydrocarbon product comprises at least one organochloride contaminant;

b) contacting the mixture with a dechlorination catalyst selected from the group consisting of silica, silica-alumina, alumina, zinc oxide, titania, zirconia, magnesium oxide, activated carbon, a zeolite, and combinations thereof within the catalytic dechlorination zone under catalytic dechlorination conditions to provide an effluent comprising: i) the carrier gas, ii) HCl, and iii) a dechlorinated hydrocarbon product; and c) via a distillation unit, separating the dechlorinated hydrocarbon product from the carrier gas and the HCl.

2. The process according to claim 1, wherein the mixture fed to the catalytic dechlorination zone has a carrier gas/hydrocarbon product molar ratio in the range from about 0.1-50.

3. The process according to claim 1, wherein the carrier gas is selected from the group consisting of nitrogen, hydrogen, a C1-C4 hydrocarbon, and combinations thereof.

4. The process according to claim 1, wherein the catalytic dechlorination conditions include a temperature in the range from about 40° F. to 700° F.

5. The process according to claim 4, wherein the catalytic dechlorination conditions further include a pressure in the range from about 10 to 1000 psig, and a liquid hourly space velocity (LHSV) feed rate in the range from about 0.1 to 50 hr-1.

6. The process according to claim 1, wherein:

the hydrocarbon product is produced in a hydrocarbon conversion zone via an ionic liquid catalyzed alkylation reaction, and the process further comprises:

d) recycling at least one of the carrier gas and the HCl from the distillation unit to the hydrocarbon conversion zone.

7. The process according to claim 1, wherein a second chloride content of the dechlorinated hydrocarbon product is at least 20% less than a first chloride content of the hydrocarbon product.

8. The process according to claim 1, wherein the dechlorinated hydrocarbon product is selected from the group consisting of alkylate gasoline, diesel fuel, jet fuel, base oil, and combinations thereof.

9. A dechlorination process, comprising:

a) feeding a mixture from an ionic liquid catalyzed hydrocarbon conversion reaction in a hydrocarbon conversion zone to a catalytic dechlorination zone, wherein the mixture comprises a hydrocarbon product and a carrier gas, and the hydrocarbon product comprises at least one organochloride contaminant;

b) contacting the organochloride contaminant with a dechlorination catalyst selected from the group consisting of silica, silica-alumina, alumina, zinc oxide, titania, zirconia, magnesium oxide, activated carbon, a zeolite, and combinations thereof within the catalytic dechlorination zone under catalytic dechlorination conditions to provide: i) the carrier gas, ii) HCl, and iii) a dechlorinated hydrocarbon product; and c) separating the dechlorinated hydrocarbon product from the carrier gas and the HCl.

10. The process according to claim 9, wherein:

the catalytic dechlorination conditions include a temperature in the range from about 40° F. to 700° F., and the carrier gas/hydrocarbon product molar ratio of the mixture is in the range from about 0.1-50.

11. The process according to claim 9, wherein:

a second chloride content of the dechlorinated hydrocarbon product is at least 20% less than a first chloride content of the hydrocarbon product, and the dechlorinated hydrocarbon product is selected from the group consisting of alkylate gasoline, diesel fuel, jet fuel, base oil, and combinations thereof.

12. The process according to claim 9, wherein:

the carrier gas comprises an isoparaffin, and the method further comprises:

d) after step c), recycling at least one of the carrier gas and the HCl to the hydrocarbon conversion zone.

13. The process according to claim 9, wherein:

step c) comprises separating the dechlorinated hydrocarbon product from the carrier gas and the HCl via a distillation unit, and the catalytic dechlorination zone is integral with the distillation unit.

14. An integrated hydrocarbon conversion and hydrocarbon product dechlorination process, comprising:

a) contacting a first reactant comprising a C4-C10 isoparaffin and a second reactant comprising a C2-C10 olefin with an ionic liquid catalyst in a hydrocarbon conversion zone under hydrocarbon conversion conditions to provide a biphasic mixture;

b) separating the biphasic mixture into an ionic liquid phase and a hydrocarbon phase, wherein the hydrocarbon phase comprises a hydrocarbon product and the first reactant, and the hydrocarbon product comprises at least one organochloride contaminant;

c) contacting the hydrocarbon phase with a dechlorination catalyst selected form the group consisting of silica, silica-alumina, alumina, zinc oxide, titania, zirconia, magnesium oxide, activated carbon, a zeolite, and combinations thereof within a catalytic dechlorination zone under catalytic dechlorination conditions including a temperature in the range from about 40° F. to 700° F., a pressure in the range from about 10 to 1000 psig, and a liquid hourly space velocity (LHSV) feed rate in the range from about 0.1 to 50 $hr^{-1}$ to provide: i) the first reactant, ii) HCl, and iii) a dechlorinated hydrocarbon product;

and d) separating the dechlorinated hydrocarbon product from the first reactant and the HCl.

15. The process according to claim 14, wherein the hydrocarbon phase has a first reactant/hydrocarbon product molar ratio in the range from about 0.1-50.

16. The process according to claim 14, wherein:

step d) comprises separating the dechlorinated hydrocarbon product from the first reactant and the HCl via a distillation unit, and the process further comprises:

e) recycling at least one of the first reactant and the HCl from the distillation unit to the hydrocarbon conversion zone.

17. The process according to claim 14, wherein the first reactant comprises isobutane.

18. The process according to claim 14, wherein:

a second chloride content of the dechlorinated hydrocarbon product is at least 20% less than a first chloride content of the hydrocarbon product, and the dechlorinated hydrocarbon product is selected from the group consisting of alkylate gasoline, diesel fuel, jet fuel, base oil, and combinations thereof.

* * * * *